United States Patent [19]

Gailey

[11] Patent Number: 4,736,564

[45] Date of Patent: Apr. 12, 1988

[54] CONVERSION CEILING PAN AND SYSTEM

[75] Inventor: J. Lynn Gailey, Newton Falls, Ohio

[73] Assignee: Alcan Aluminum Corporation, Cleveland, Ohio

[21] Appl. No.: 916,602

[22] Filed: Oct. 8, 1986

[51] Int. Cl.[4] ..... E04B 5/52

[52] U.S. Cl. ..... 52/484; 52/486; 52/488; 52/489

[58] Field of Search ..... 52/144, 145, 401, 484, 52/485, 486, 489, 475, 476, 508, 588, 608, 126.6, 483, 488

[56] References Cited

U.S. PATENT DOCUMENTS

| | | | |
|---|---|---|---|
| 1,385,217 | 7/1921 | Lutz | 52/773 |
| 1,842,795 | 1/1932 | Miller | 52/485 |
| 1,933,221 | 10/1933 | Rockhoff | 52/483 |
| 2,073,036 | 3/1937 | Voigt | 52/508 |
| 2,153,320 | 4/1939 | Venzie | 52/144 |
| 2,984,323 | 5/1961 | Lehmann | 52/588 |
| 3,023,866 | 3/1962 | Moore | 52/489 |
| 3,139,162 | 6/1964 | Spangenberg | 52/484 |
| 3,207,057 | 9/1965 | Brown et al. | 52/401 |
| 3,295,284 | 1/1967 | Tschiesche | 52/489 |
| 3,318,057 | 5/1967 | Norsworthy | 52/126.6 |
| 3,645,051 | 2/1972 | Kolesar | 52/484 |
| 3,871,150 | 3/1975 | Murray et al. | 52/489 |
| 4,128,357 | 12/1978 | Barth et al. | 52/608 |
| 4,272,937 | 6/1981 | Brugman | 52/483 |
| 4,361,996 | 12/1982 | Smith | 52/484 |
| 4,413,457 | 11/1983 | Lahm et al. | 52/145 |
| 4,444,524 | 4/1984 | Cook et al. | 52/489 |
| 4,483,116 | 11/1984 | Gailey | 52/489 |
| 4,494,346 | 1/1985 | Gailey | 52/489 |

FOREIGN PATENT DOCUMENTS

| | | | |
|---|---|---|---|
| 313305 | 9/1917 | Fed. Rep. of Germany | 52/476 |

*Primary Examiner*—James L. Ridgill, Jr.

*Attorney, Agent, or Firm*—Renner, Otto, Boisselle & Lyon

[57] ABSTRACT

The conversion ceiling system disclosed may be installed immediately under a pre-existing ceiling without dismantling or removing the pre-existing ceiling. The conversion ceiling system includes pans which are adapted to cooperate with conventional inverted T-beams which, if pre-existing, support the pre-existing ceiling panels. The T-beams support the conversion pans in a side-by-side array to form a new ceiling surface. Each of the conversion pans includes a horizontally extending plate having a specially formed upwardly turned peripheral rim. At least two portions of the rim include laterally projecting tabs for engaging the flanges of T-beams and at least one of the tabs has an upstanding stop to limit the horizontal movement of the pan. The ceiling assembly may include a number of resilient clips securing the upstanding stops on the rims of the pans to the T-beams. Alternately, the pre-existing ceiling tiles may engage the stop to prevent horizontal movement of the pans. Filler pieces mask the T-beams in the proximity of light fixtures, ventilation ducts, walls and the like, giving the ceiling a continuous one-piece appearance. The conversion pans may be made of metal or other material, and various decorative coatings including mirror-like finishes may be applied to the exposed portion of the pans.

19 Claims, 2 Drawing Sheets

FIG. 1
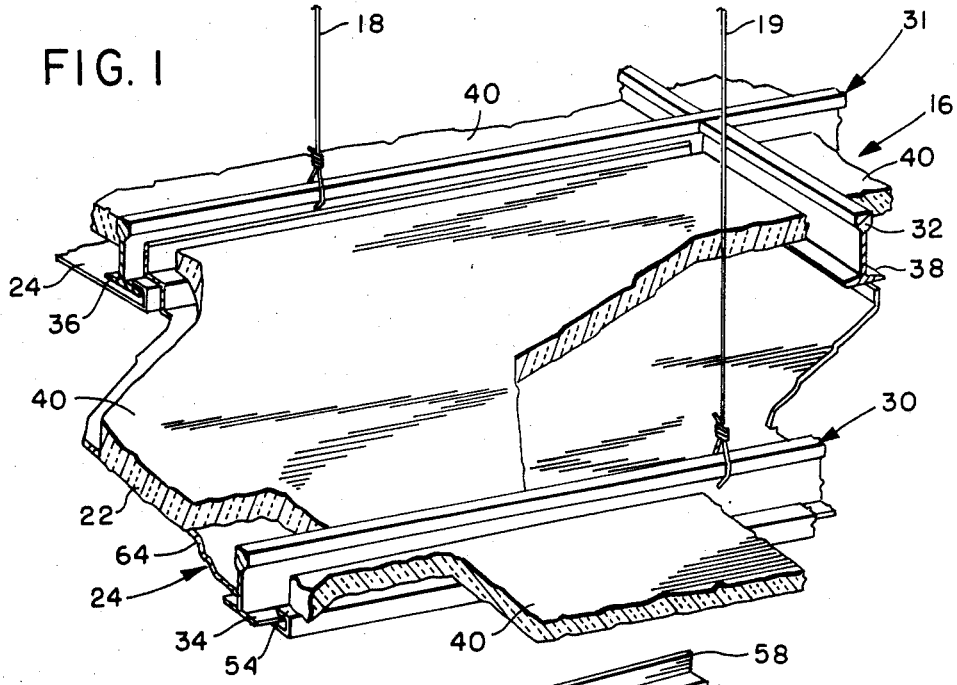
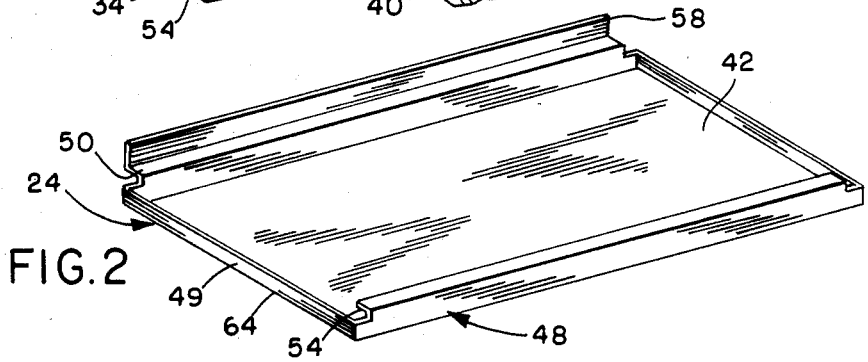
FIG. 2
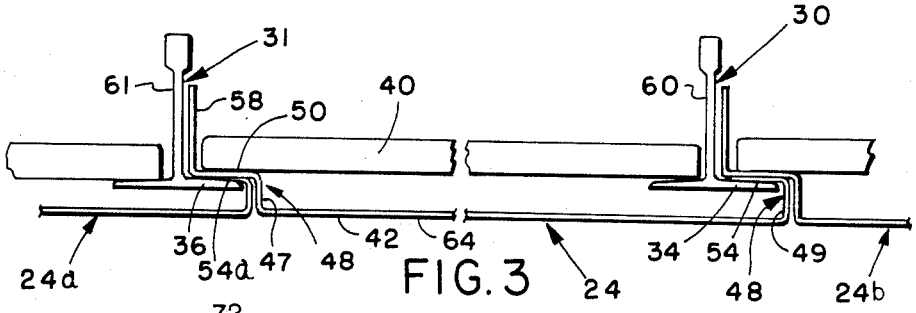
FIG. 3
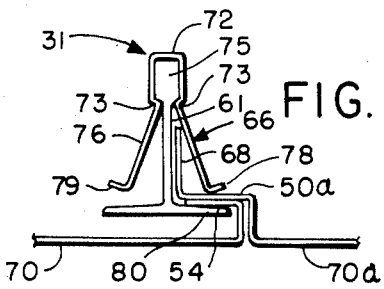
FIG. 4
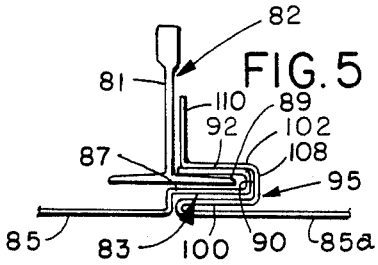
FIG. 5

FIG. 6
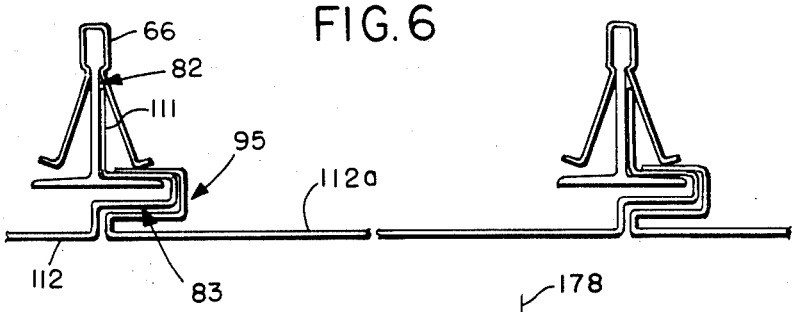
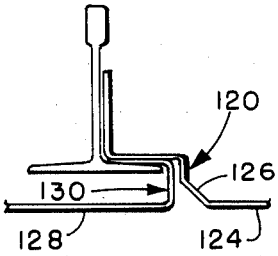
FIG. 7
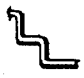
FIG. 8
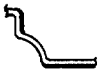
FIG. 9
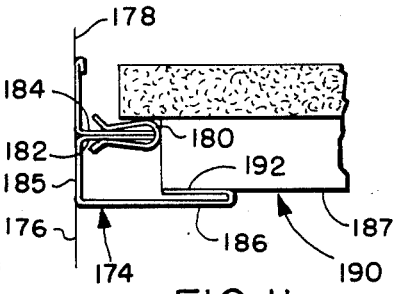
FIG. 11
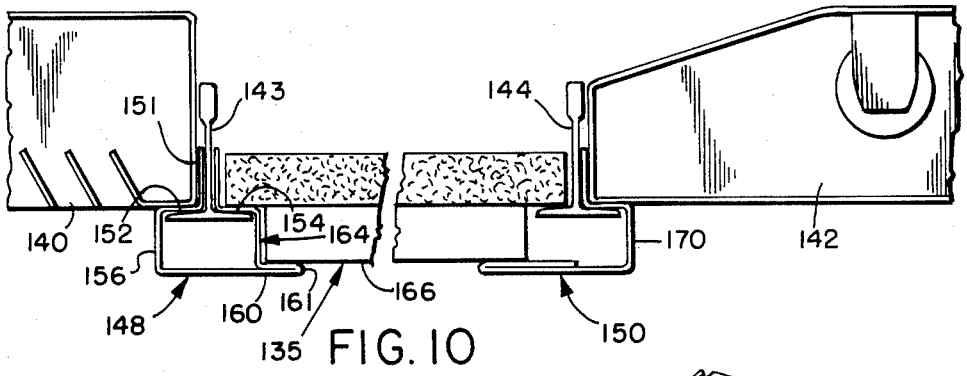
FIG. 10
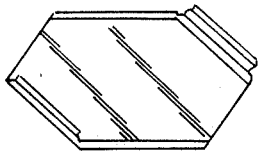
FIG. 12
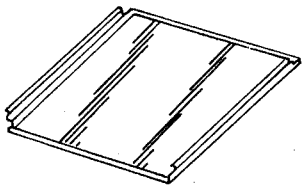
FIG. 13
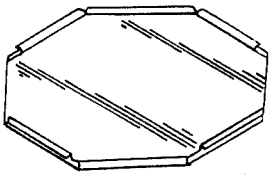
FIG. 14

CONVERSION CEILING PAN AND SYSTEM

TECHNICAL FIELD

This invention is useful in the art of suspended ceilings, particularly suspended ceilings comprising an array of generally horizontally extending ceiling panels supported by a plurality of horizontally extending T-beams. Specifically, this invention is directed to conversion ceiling pans and a ceiling assembly employing such pans.

BACKGROUND OF THE INVENTION

Suspended ceilings are widely used in interior construction for aesthetic purposes and other reasons. A typical suspended ceiling comprises an assembly of panels that are spaced below the true or structural ceiling of a room and are carried by inverted T-beams or other like horizontal stringers which are themselves suspended from the true ceiling. A common design for such suspended ceilings employs a planar grid of inverted T-beams and an array of drop-in ceiling panels or tiles. Such grids generally include an array of parallel spaced main runs suspended from the true ceiling and an array of parallel spaced cross runs connected to and supported at their ends by the main runs. Drop-in ceiling panels are positioned in the openings defined by the grid and supported by the flanges of the inverted T-beams surrounding each opening. The openings defined by the grid are generally square or rectangular, however a variety of shapes are possible. These types of ceiling systems are generally referred to as drop-in ceilings and are disclosed, for example, in U.S. Pat. Nos. 2,994,113; 3,246,432; 4,063,391 and 4,086,480.

When redecorating or at other times it may be desirable to replace the existing drop-in ceiling. Recently, conversion systems employing relatively narrow elongated panels have been disclosed. These systems may be attached to the pre-existing grid of T-beams without removing the existing drop-in panels. Examples of such conversion systems are disclosed in U.S. Pat. Nos. 4,483,116 and 4,361,916. These types of conversion ceiling systems may not suit the decorative style or taste of the occupant. It may be necessary or desirable to preserve a decorative appearance similar to that of the preexisting drop-in ceiling. At other times it may be desirable to create an appearance which departs significantly from that of both the preexisting drop-in ceiling and the narrow, elongated panel systems.

In addition to narrow, elongated conversion systems, various remodeling ceiling clips have been disclosed, for example, in U.S. Pat. No. 3,871,150 which assist in mounting a new ceiling. As with some conversion systems, the use of such clips is not always acceptable. Such clips are generally limited to supporting square or rectangular panels, and subsequent to installation a significant gap may remain between the new ceiling panels exposing the flange of the clip. When employing such clips the installation process can become complex and cumbersome.

SUMMARY OF THE INVENTION

The present invention comprises a plurality of ceiling conversion pans for installation upon the flanges of inverted T-beams. The pans may be constructed of a variety of materials including, but not limited to, plastic, aluminum, steel, copper, and brass. Additionally, the exposed surfaces of the pans may include any one of a variety of surface finishes. Such surfaces may for example be color painted, anodized, textured, or even highly polished to a mirror-like appearance. The pans may also include perforations or designs embossed upon their exposed surfaces. The pans may be formed by various techniques known to those skilled in the art such as rolling, pressing, stamping, extruding, machining, welding, and the like.

Each pan comprises a horizontally extending plate having an upwardly turned peripheral rim. Upon installation of the pan, the bottom of the plate forms the inner or exposed surface of the new or converted ceiling. At least two portions of the rim have horizontally projecting tabs which engage the flanges of the T-beams and at least one of the tabs has an upstanding stop to limit the horizontal movement of the pans. The horizontal tabs rest on the flanges of the T-beams, and when installed there is intimate edge-to-edge contact between the individual conversion pans. Thus, the preexisting ceiling and T-beams are completely hidden by the pans. The conversion pans may be installed in conjunction with a number of resilient clips which firmly secure the upstanding stops on the rims of the pans to the webs of the T-beams. Alternatively, the ceiling panels of a preexisting ceiling system may serve to prevent horizontal movement of the conversion pan by trapping the stops between the webs of the T-beams and the edge of the pre-existing panel.

The conversion pans are easily installed under the pre-existing drop-in ceiling panels by first positioning the portions of the rim having tabs up against the panels, raising the panels and the pans until the tabs of the pan are positioned above and to one side of the flanges of the beams, moving the pan to the other side until the tabs touch the webs of the beams, and releasing the pan, the tabs being supported by the flanges of the T-beams. Horizontal movement of the conversion pans within a row is prevented by the rim of one pan abutting the rim of an adjacent pan.

The invention also includes various types of filler pieces of different configurations for use between the pans and light fixtures, ventilation ducts, walls and the like. The filler pieces mask the flanges of the T-beams in the proximity of these items and lend continuity to the appearance of the new ceiling.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 1 is a partially cut away perspective view of a ceiling system illustrating one preferred embodiment of the present invention;

FIG. 2 is a perspective view of one of the rectangular ceiling pans illustrated in FIG. 1;

FIG. 3 is a front elevational cross-sectional view of the ceiling system illustrated in FIG. 1;

FIG. 4 is a cross-sectional view illustrating another embodiment of the invention in the proximity of an inverted T-beam and which includes a resilient clip to secure a pan to the beam;

FIG. 5 is a cross-sectional view illustrating another embodiment of the invention;

FIG. 6 is a cross-sectional view illustrating another embodiment of the invention which includes a resilient clip to secure a pan to an inverted T-beam;

FIG. 7 is a cross-sectional view of a pan like that shown in FIG. 5 but in which the rim includes a beveled edge;

FIG. 8 is a cross-sectional view of another variation of the pan of FIG. 5 in which the rim includes a rabbeted periphery;

FIG. 9 is a cross-sectional view of another variation of the pan of FIG. 5 wherein the rim includes an arcuate indentation;

FIG. 10 is a cross-sectional view of the embodiment of the invention illustrated in FIG. 3 and illustrating filler pieces for use in the proximity of ventilation units and light fixtures;

FIG. 11 is a cross-sectional view of the embodiment of the invention illustrated in FIG. 2 and illustrating a filler piece and clip for use in the proximity of a wall;

FIG. 12 is a perspective view of a hexagonal pan constructed in accordance with the present invention;

FIG. 13 is a perspective view of a square pan constructed in accordance with the present invention; and FIG. 14 is a perspective view of an octagonal pan constructed in accordance with the present invention.

DETAILED DESCRIPTION OF PREFERRED EMBODIMENTS

FIG. 1 illustrates a conversion ceiling pan system 16 constructed in accordance with the present invention. The system 16 is suspended by wires 18 and 19 from a superadjacent building structure (not shown) and comprises generally a pre-existing drop-in ceiling system 22 and a plurality of conversion pans 24 that depend from and extend beneath the drop-in ceiling system 22.

The pre-existing ceiling system 22 is formed of a plurality of elongated inverted T-beams arranged in an array of main runs 30 and 31 and an array of cross runs 32. The main runs 30 and 31 are suspended from the wires 18 and 19. The cross runs 32 are formed of separate elongated inverted T-beams whose opposite ends rest on the flanges of the main runs 30 and 31. The main and cross runs 30, 31 and 32 cooperate to define a reticulated grip forming an array of rectangular panel openings. However, it will be appreciated that the main and cross runs may be arranged in various manners so as to form openings of other configurations.

In the usual installation the main and cross runs 30, 31 and 32 define a horizontal plane, and this description will proceed with this in mind. It will be readily appreciated that ceilings are not always horizontal and that drop-in ceiling systems and the present invention may be used on inclined ceilings or gently curved ceilings. The terms horizontal, vertical and the like should be understood as equally applicable to such ceilings, and are used herein merely for convenience of description and not by way of limitation.

The inverted T-beams include horizontally extending flanges some of which are designated by numerals 34, 36 and 38. The flanges provide support for both pre-existing ceiling panels 40 and the conversion pans 24. Panels 40 fit in the rectangular openings defined by the main and cross runs and are composed of fiberboard, for example, or other materials, many such materials being known in the art. The pre-existing ceiling system 22 may include, for example, lighting fixtures, sprinklers, speakers, ventilation equipment, etc., integrated with the conversion ceiling system 16 or installed above or below it.

Referring now to FIGS. 2 and 3, each conversion pan 24 constructed in accordance with the present invention includes a plate or major planar structure 42 and a peripheral rim 48 which extends upward from the surface 42. The rim 48 includes a peripheral wall 49 which extends along the entire perimeter of the planar surface 42 generally normal thereto. One portion of the vertical wall 49 includes a tab 50 which projects outward horizontally beyond the vertical wall 49 of the rim 48 (to the left as viewed in FIGS. 2 and 3). The portion of the rim opposite tab 50 includes an inwardly projecting horizontal tab 54 which engages the flange 34. The two tabs 50 and 54 extend in the same direction, i.e., both extend to the left from their respective portions of the rim 48 as viewed in FIGS. 2 and 3 and are supported by the flanges 36 and 34, respectively as shown in FIG. 3.

The conversion pan 24 is prevented from moving horizontally in one direction (to the left as viewed in FIG. 3) by contact between the webs 60 and 61 of the T-beams 30 and 31, respectively, and the distal edges of the tabs 50 and 54 and stop 58. Horizontal movement in the opposite direction is prevented by the rim 48 abutting the rim of the adjacent pans **24*a* and 24*b* and by stop 58 which fits between the web 61 of the T-beam 31 and the ceiling panel 40**. Horizontal movement in the remaining two directions is also prevented by the rim of one pan abutting the rim of an adjacent pan.

The vertical height of the vertical wall 49 of the rim 48 varies to keep the major, exposed surface 64 horizontal. As illustrated in FIG. 3, upon installation of the pan 24, the outwardly projecting tab 50 will rest upon the inwardly projecting tab **54*a* of the adjacent conversion pan 24*a*. In order to keep the exposed surface 64 of the pan level and in the same plane with the exposed surface of the adjacent pans 24*a* and 24*b*, the portion of the wall 49 from which the tab 50 (on the left in FIG. 3) projects must be longer than the portion of the wall 49 from which the tab 54 (on the right in FIG. 3) projects by a distance equal to the thickness of the inwardly projecting tab 54. In this way the major surface 64 is kept parallel to the plane defined by the flanges 34 and 36** of the T-beams.

It is contemplated that the present invention may be used without a pre-existing ceiling panel. In this case a clip 66 (FIG. 4) is provided to prevent horizontal movement of the conversion pan 70. In FIG. 4 the same reference numerals have been used to indicate similar parts. Except as discussed below the pans 24 and 70 are identical.

Unlike the embodiment illustrated in FIGS. 1–3, in the FIG. 4 embodiment an upstanding stop 68 projects from the *inwardly* projecting tab 54 and the *outwardly* projecting tab 50 does not include such a stop. With the embodiment of FIG. 4, when adjacent pans 70 are positioned on a T-beam grid, the upstanding stop 68 extends from the lower of the two tabs 54 and 50, rather than from the upper of the two tabs as in the embodiment of FIGS. 1–3.

Once pan 70 (FIG. 4) has been installed with stop 68 abutting the web 61 of the T-beam 31, a resilient clip 66 is placed over the top of the T-beam as shown in FIG. 4. The clip 66 prevents horizontal movement of the conversion pan 70.

The arrangement with the stop 68 extending from the inwardly projecting tab 54 facilitates the use of a resilient clip 66 for securing the pan to the T-beam 31. When clips 66 are employed, the conversion ceiling becomes a rigid one-piece-like unit facilitating the future washing or painting of the ceiling.

The clip 66 includes a pair of legs 76 and 78 connected by a U-shaped end portion 72. The U-shaped end portion 72 grips the top portion of the T-beam 31. The typical T-beam 31 includes a bead 75 of enlarged cross section along its uppermost edge. The U-shaped end portion 72 of the clip 66 has shoulders 73 which grip the underside of the bead 75 to prevent upward movement of the clip 66 once it is installed.

The leg 76 of the clip 66 on one side of the T-beam 31 runs along the web 61 of the T-beam. The other leg 78 on the other side of the beam 31 engages the stop 68 of the inwardly projecting tab 54 of pan 70 and the outwardly projecting tab 50*a* of the adjacent pan 70*a*. The legs 76 and 78 are not parallel to the web 61, instead they flair outward slightly from the shoulders 73. Each leg includes a foot 79 and the length of the leg 78 is selected so that the foot 79 contacts or nearly contacts the horizontal tab 50 of the adjacent conversion panel 70. This limits or prevents upward displacement of the pans. The clip 66 may be made out of a variety of materials such as plastic, metal, or spring steel. By forming the stop 68 on the inwardly projecting tab 54 it is possible to install the clip 66 onto the beam before the adjacent pan 70*a* is installed. Upon installation of the adjacent pan 70*a* the outwardly projecting tab 50*a* of the adjacent pan 70*a* simply slides underneath the leg 78 and foot 79.

In the previously described embodiments the seam between adjacent conversion pans is approximately in vertical alignment with one edge of the flange of the T-beam, e.g., edge 80 of T-beam 31 in FIG. 4. There may be circumstances in which it is desirable to have the seam visible to the occupant to be in alignment with the web of the T-beam. In the FIG. 5 embodiment, the seam between adjacent pans is in vertical alignment with the web 81 of the T-beam 82. To this end the rim 83 of the conversion pan 85 comprises a first horizontally extending leg 87 with a length approximately equal to one-half the width of the flange 89 of the T-beam 82, a vertically extending leg 90 with a length approximately equal to the thickness of the flange 89 and a return leg 92 which extends in the opposite direction and has a length slightly shorter than that of the first leg 87.

The rim 95 of the adjacent ceiling pan 85*a* conforms to the configuration of the rim 83. The rim 90 comprises parallel horizontally extending legs 100 and 102 each with a length slightly less than one-half the width of the flange 89. The legs 100 and 102 are connected by a vertically extending leg 108 with a length slightly longer than the leg 90 of the adjacent conversion pan 85. In this way the legs 100, 102 and 108 of conversion pan 85a may be fit around the corresponding legs 87, 90 and 92 of conversion pan 85. The vertical lengths of rim portions 83 and 95 of conversion pans 85 and 85*a*, respectively, are proportional to maintain the exposed surfaces of the pans 85 and 85*a* coplanar. In this embodiment of the invention the inwardly projecting rim 95 further includes an upstanding stop 110. The stop 110 serves the same function as the stop 58 of the previously illustrated embodiment of FIGS. 1–3.

In FIG. 6 another embodiment of the invention is illustrated which utilizes clip 66. Except as discussed below, the pans 112 and 112*a* of FIG. 6 are identical to the pans 85 and 85*a* of FIG. 5. Upstanding stop 114 of pan 112 extends from the outwardly projecting portion of the rim 83 instead of the inwardly projecting portion of the rim 95. This facilitates the use of the resilient clip 66 to secure the pan to the T-beam 82 as discussed in connection with FIG. 4.

In FIG. 7 a further variation of the invention is shown wherein the rim 120 of the pan 124 includes an angled or beveled indentation 126 which gives the ceiling a different appearance. As illustrated, the adjacent pan 128 includes a square edge. However, it will be appreciated that the rim 130 of the adjacent pan 128 may also include an angular indentation.

In FIGS. 8 and 9, additional variations of the edge of the rim are shown. In FIG. 8 the rim includes a rabbet which forms an L-shape indentation and in FIG. 9 the edge includes an arcuate indentation. Although only three variations of the rim edge have been shown, it will be appreciated that numerous variations are possible. The rim treatment illustrated in FIGS. 7, 8 and 9 may be applied to any of the embodiments of the conversion pan illustrated in FIGS. 1–6.

While viewing the cross-sectional views of FIGS. 3–9, it will be appreciated that the opposite rim portion not illustrated of one pan will be identical in configuration to the illustrated rim portion of the other adjacent pan, and likewise the opposite rim portion not illustrated of the other pan will be identical in configuration to the illustrated rim portion of the one pan.

In FIG. 10 a conversion pan 24 is illustrated as it would appear adjacent to a ventilation unit 140 and a light fixture 142. In order to conceal the flanges of the T-beams 143 and 144 from view the invention provides for filler pieces 148 and 150. The filler piece 148 comprises a vertically upstanding stop 151, a horizontally extending leg 152 with a length approximately equal to one-half the width of the flange 154, a vertical leg 156 with a length that allows the pan 135 to be supported in the plane defined by adjacent panels, and a return leg 160 with a lip 161 and a length greater than the width of the flange 154. The return leg extends beyond the rim 164 of conversion pan 135 and contacts the exposed surface of the pan 166. The filler piece 150 is essentially the same as filler piece 148 except the vertical leg 170 of filler 150 is slightly longer than the vertical leg 156 of filler 148 since filler 148 does not rest on the rim of pan 135 as does filler piece 150. With the fillers 148 and 150 the various fixtures and openings that appear in a ceiling may be properly trimmed to conceal the original inverted T-beams.

FIG. 11 illustrates a filler piece 174 which may be used next to a wall 176. The filler piece 174 is attached to a pre-existing L-shape beam 178 by clip 180 which is in turn attached to wall 176. The filler piece 174 comprises a first horizontal leg 182 with a length equal approximately to that of the horizontal leg 184 of the L-beam 178 and a vertical leg 185 with a length that allows the second horizontal leg 186 to be supported in a plane jsut below the plane defined by the exposed surface 187 of pan 190. Note that when a wall filler piece 174 is employed, the pan 190 at the end 192 closest to the wall is straight and does not include a rim portion or a tab of any type.

FIGS. 12–14 illustrate pans of different configurations which this invention may encompass. FIG. 12 illustrates a hexagonal pan and FIG. 13 illustrates a rectangular pan. FIG. 14 illustrates an octagonal pan with tabs on four of its edges. It will be appreciated that when installing a conversion pan ceiling system various shape pans may be employed in the same ceiling. When installing octagonal shape pans, square shape pans are used to fill the gaps between the octagonal shape pans.

Thus it is clear that the present invention provides a conversion ceiling system 16 comprising a plurality of ceiling conversion pans 24, 70, 85, 112 for installation upon the flanges of inverted T-beams. Although the invention provides a convenient means for installing a new ceiling under a pre-existing ceiling it will be appreciated that the invention is also well suited for use, for example, in a new building having no pre-existing ceiling system.

The conversion pans may be constructed of a variety of materials including, but not limited to, plastic, aluminum, steel, copper, and brass. Additionally, the exposed surfaces of the pans may include any one of a variety of surface finishes for example color painted, anodized, textured, or highly polished to a mirror-like appearance. The pans may also include perforations or designs embossed upon their exposed surfaces. The pans may be formed by various techniques known to those skilled in the art such as rolling, pressing, stamping, extruding, machining, welding, and the like.

Each pan 24 (FIGS. 1–3) comprises a horizontally extending plate 42 having an upwardly turned peripheral rim 48. Upon installation of the pan 24, the bottom of the plate constitutes the inner or exposed surface of the new or converted ceiling. At least two portions of the rim have horizontally projecting tabs 50, 54 which engage the flanges of the T-beams and at least one of the tabs (50) has an upstanding stop 58 to limit the horizontal movement of the pan. The horizontal tabs 50 and 59 rest on the flanges of the T-beams, and when installed there is intimate edge-to-edge contact between the individual conversion pans. Thus, the pre-existing ceiling and T-beams are completely hidden by the pans. The conversion pans, e.g., 70 (FIG. 4), may be installed in conjunction with a number of resilient clips 66 which firmly secure the upstanding stops 68 on the rims of the pans to the webs of the T-beams. Alternatively, the ceiling panels of a pre-existing ceiling system may serve to prevent horizontal movement of the conversion pan by trapping the stops between the webs of the T-beams and the edge of the pre-existing panel.

The invention also provides various types of filler pieces 148, 150, 174 of different configurations for use between the pans and light fixtures, ventilation ducts, walls and the like. The filler pieces mask the flanges of the T-beams in the proximity of these items and lend continuity to the appearance of the new ceiling.

I claim:

1. A ceiling system comprising a pre-existing inverted T-beam ceiling structure and a plurality of conversion pans, said inverted T-beam ceiling structure including a reticulated grip of inverted T-beams, each having a generally vertical web and at least one horizontal flange and a plurality of pre-existing ceiling panels fitting within the space defined by contiguous T-beam webs and supported by the flanges thereof, each of said pans including a horizontally extending plate and an upwardly turned peripheral rim, said rim including first and second portions, said first portion of said rim having first tab means projecting laterally therefrom for engaging the flange of one of said beams, said second portion of said rim having second tab means projecting laterally in the same direction as said first tab means for engaging the flange on another of said beams, at least one of said tab means including an upstanding stop having surface means for limiting horizontal movement of said pan, each of said stop surface means being positioned to fit between the periphery of a pre-existing ceiling panel and the adjacent web of an inverted T-beam.

2. The ceiling system of claim 1 wherein the rims of adjacent pans are in abutting engagement with each other whereby the pre-existing inverted T-beams are concealed from view from below the ceiling system.

3. A ceiling system as set forth in claim 1 wherein at least one of said rim portions of one of said pans includes a generally L-shape indentation at the juncture of the plate and rim.

4. A ceiling system as set forth in claim 1 wherein at least one of said rim portions of one of said pans includes a generally arcuate indentation at the juncture of the plate and rim.

5. A ceiling system as set forth in claim 1 wherein at least one of said rim portions of one of said pans includes an angular indentation at the juncture of the plate and rim.

6. A ceiling system as set forth in claim 1 wherein at least one of said pans has a generally square shape.

7. A ceiling system as set forth in claim 1 wherein at least one of said pans has a generally rectangular shape.

8. A ceiling system as set forth in claim 1 wherein at least one of said pans has a generally hexagonal shape.

9. A ceiling system as set forth in claim 1 wherein at least one of said pans has a generally octagonal shape.

10. A ceiling system as set forth in claim 1 wherein said rim includes leg means for positioning said plates in approximately coplanar relationship.

11. A ceiling system as set forth in claim 10 wherein said leg means for positioning said plate includes one of said portions of said rim being longer than the other of said rim portions by a distance equal to the thickness of one of said tab means.

12. A ceiling system as set forth in claim 11 wherein the tab means of said longer rim portion includes said upstanding stop.

13. A ceiling system as set forth in claim 11 wherein the tab means of said shorter rim portion includes said upstanding stop.

14. A ceiling system as set forth in claim 1 wherein said rim includes leg means for positioning at least one of said seams between adjacent pans in approximate vertical alignment with the web of one of said T-beams.

15. A ceiling system as set forth in claim 14 wherein said leg means includes a first horizontally projecting leg the approximate length of the flange of one of said beams, a first vertical leg the approximate length of the thickness of the flange, and a first return leg extending in the opposite direction and having the approximate length of said first horizontally projecting leg, and said tab means of said second rim portion comprises a second horizontally projecting leg projecting in the same direction as said first horizontally projecting leg and having the approximate length of said first horizontally projecting leg, a second vertical leg the approximate length of said first vertical leg, and a second return leg extending in the opposite direction and having the approximate length of said second horizontally projecting leg.

16. A ceiling system as set forth in claim 15 wherein said tab means having a stop is proportioned to fit around the outside surface of said tab means of an adjacently arrayed pan.

17. A ceiling system as set forth in claim 15 wherein said tab means of one of said portions of one of said pans which includes a stop is proportioned so as to allow the tab means of an adjacently arrayed pan to fit around the outside surface of said tab means of one of said portions of said pans which includes a stop.

18. A ceiling pan for use in conjunction with a plurality of generally parallel horizontally extending inverted T-beams and ceiling panels supported by the inverted T-beams, said pan comprising a horizontally extending plate portion and an upwardly turned peripheral rim, said rim including first and second portions, said first portion of said rim having a first tab means projecting laterally therefrom for engaging one of said T-beams, said second portion of said rim having second tab means projecting laterally in the same directions as said first tab means for engaging another pan, at least one of said tab means including an upstanding stop having surface means positioned between a vertical face of an inverter T-beam and an edge face of a ceiling panel for limiting horizontal movement of said pan, said tab means of said first rim portion comprising a first horizontally projecting leg, a first vertical leg, and a first return leg extending in the opposite direction of said first horizontally projecting leg and having the approximate length of said first horizontally projecting leg, and said tab means of said second rim portion comprising a second horizontally projecting leg extending in the same direction as said first horizontally projecting leg and having the approximate length of said first horizontally projecting leg, a second vertical leg the approximate length of said first vertical leg, and a second return leg extending in the opposite direction of said second horizontally projecting leg and having the approximate length of said second horizontally projecting leg.

19. A pan as set forth in claim 18 and adapted for use in connection with a plurality of said pans, each of said pans abutting its neighbors to form a generally planar ceiling which conceals the inverted T-beams from view from below, said second tab means of one of said pans resting on the first tab means of its neighbor, said first tab means of said neighbor resting on a flange of a T-beam, said first and second rim portions of said pans being proportioned to maintain said plate portions coplanar when said first tab means of each of said pans rests on a flange of a T-beam and said second tab means of each of said pans rests on said first tab means of its neighbor.

* * * * *